United States Patent [19]

Kojima et al.

[11] 3,985,390

[45] Oct. 12, 1976

[54] TUNNEL EXCAVATOR

[75] Inventors: Chiaki Kojima, Tokyo; Hiroshi Ohta, Chigasaki; Hidekazu Aoki, Tokyo, all of Japan

[73] Assignee: Kabushiki Kaisha Komatsu Seisakusho, Tokyo, Japan

[22] Filed: Mar. 18, 1975

[21] Appl. No.: 559,539

[30] Foreign Application Priority Data

| | | |
|---|---|---|
| Mar. 18, 1974 | Japan | 49-30130 |
| Mar. 18, 1974 | Japan | 49-30131 |
| Mar. 18, 1974 | Japan | 49-30132 |
| Mar. 18, 1974 | Japan | 49-30133 |

[52] U.S. Cl. ..... 299/31; 61/85; 299/33

[51] Int. Cl.[2] ..... E21D 9/10; E21D 11/36

[58] Field of Search ..... 299/31, 33; 61/85, 45

[56] References Cited

UNITED STATES PATENTS

| | | | |
|---|---|---|---|
| 3,325,217 | 6/1967 | Enz | 299/31 |
| 3,547,493 | 12/1970 | Starkle | 299/75 |
| 3,840,271 | 10/1974 | Sugden | 299/31 |

FOREIGN PATENTS OR APPLICATIONS

| | | | |
|---|---|---|---|
| 479,776 | 11/1969 | Switzerland | 61/85 |

*Primary Examiner*—Ernest R. Purser
*Assistant Examiner*—William F. Pate, III
*Attorney, Agent, or Firm*—Armstrong, Nikaido & Wegner

[57] ABSTRACT

Tunnel excavator for forming an upper half annular hollow space in the solid earth. The excavator has an arch shaped shield provided with a plurality of chambers in which excavating machines are located. Each of the excavating machines is swingably supported in the respective chamber and gripper means for securely abutting against the outer and inner surfaces of the solid earth formed by the upper half annular hollow space is located in each of the chambers. Thrust generating means is connected between the respective excavating machines and the respective gripper means so that the excavating machines can be advanced by the action of the thrust generating means when the gripper means is actuated to abut against the earth.

2 Claims, 13 Drawing Figures

TUNNEL EXCAVATOR

BACKGROUND OF THE INVENTION

The present invention relates to a tunnel excavator for forming an upper half annular hollow space in the solid earth.

It has been commonly developed to use explosives in excavating a tunnel in the rocks or the solid earth. However, when explosives are used, public obstructions such as explosion sounds and vibrations thereby will take place and, depending upon the circumstances, such construction work as using explosives sometimes must be given up.

On the other hand, machines for mechanically excavating entire cross-section of a tunnel has been developed. However, the machines for excavating the entire cross-section of a tunnel of a large size are fairly expensive and, depending upon the scale of the construction work, such expensive machines can not be adopted.

In order to avoid such an expensive machine, there has been developed a process for forming a tunnel wherein an upper half annular hollow space is first formed by excavating the earth in accordance with the tunnel excavation plan and the support structure is applied to the outer boundary of the thus formed upper half annular hollow space so that the excavation is advanced to about 15m. Then, the remaining earth within the upper half annular hollow space is crushed by using explosives and removed to form the entire cross-section of the tunnel. This process is useful in that the vibration caused by the explosion of the explosives is prevented from directly propagating to the surface of the ground thereby giving a solution to the prevention of the public obstruction.

SUMMARY OF THE INVENTION

It is an object of the present invention to provide a useful and novel tunnel excavator for forming an upper half annular hollow space in the solid earth as described above.

Another object is to provide a useful and novel tunnel excavator of the type described above which permits hard rocks to be accurately excavated while it is very inexpensive suitable for any scale of the construction work.

The above objects are achieved in accordance with the present invention by the provision of a tunnel excavator having an arch shaped shield provided with a plurality of chambers in which excavating machines are located, gripper means provided in each of the chambers for securely abutting against the outer and inner surfaces of the solid formed by the upper half annular hollow space excavated by the tunnel excavator, the tunnel excavator being characterized by swinging means for swingably and rotatably supporting the excavator bodies of the excavating machines in the respective chambers except those located at the extremities of the shield, swinging means for swingably supporting the excavator bodies of the excavating machines in the chambers located at the extremities of the shield, thrust generating means provided in each of the chambers and connected between the gripper means and the excavator body for advancing the excavator body by the action of the thrust generating means when the gripper means is securely abutted against the outer and inner surfaces of the solid earth formed by the upper half annular hollow space so as to permit the earth crushing tools of the excavating machines to be operated to excavate the earth for the intended cross section thereof, pebble discharging means located at the extremities of the shield for transporting pebbles generated during the excavation of the earth out of the tunnel excavator, and supporting means located in the shield for temporarily abutting securely against the outer and inner surfaces of the solid earth, thereby permitting the gripper means to be advanced by the action of the thrust generating means during the time the gripper means is inactivated.

DETAILED DESCRIPTION OF THE PREFERRED EMBODIMENTS

Figure 2:
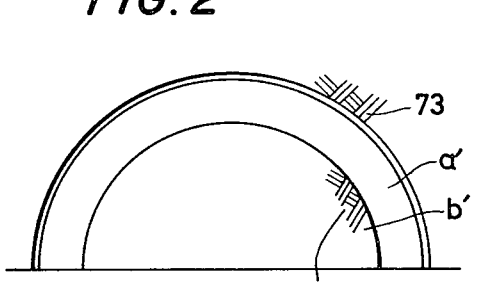
FIG. 2 is a cross-sectional view taken along line II — II in FIG. 1.
Figure 1:
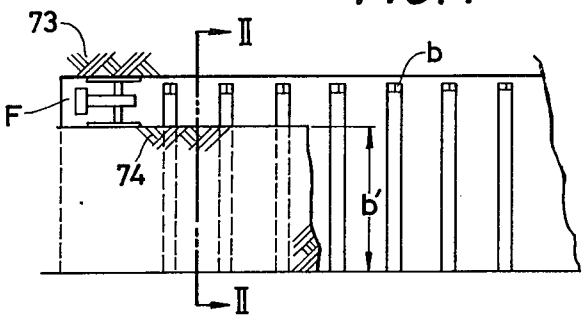
FIG. 1 is a schematic longitudinal sectional view showing the process of excavating a tunnel in the solid earth by using the tunnel excavator constructed in accordance with the present invention.

FIG. 1 shows the manner how a tunnel is formed in the solid earth. First, an upper half annular hollow space a (FIG. 2) is formed by the tunnel excavator forming a ceiling portion 73 and a remaining portion 74 formed by solid earth portion *b'*, and then supports *b* for the ceiling portion 73 are provided. After a length of about 15 m of the ceiling portion 73 is formed, the remaining portion 74 is removed by crushing the solid earth portion *b'* by using explosives so that a tunnel is formed. This procedure is repeated until a desired length of tunnel is formed. As previously described, such a procedure is advantageous in that the sounds and vibrations caused by the explosion of the explosives are prevented from directly propagating the surface of the earth.

The tunnel excavator of the present invention is intended to form the above described upper half annular hollow space in the solid earth.

Now, referring to FIGS. 3 – 13, an arch shaped shield B comprises a shield body 26 which is constructed by upper and lower skin plates 26*a*, 26*b* and partitions 26*c*. A plurality of chambers $A_1$, $A_2$ --- $A_5$ are formed in the shield body 26 by means of the partitions 26*c*. The rear portions of the upper and lower skin plates 26*a*, 26*b* are cut out so that generally rectangular cut-out portions 70 are formed. Excavating machines $\mathbf{1}_1$, $\mathbf{1}_2$, ---

$1_5$ are located in the respective chambers $A_1$, $A_2$ --- $A_5$ of the arch shaped shield B.

Figure 3:
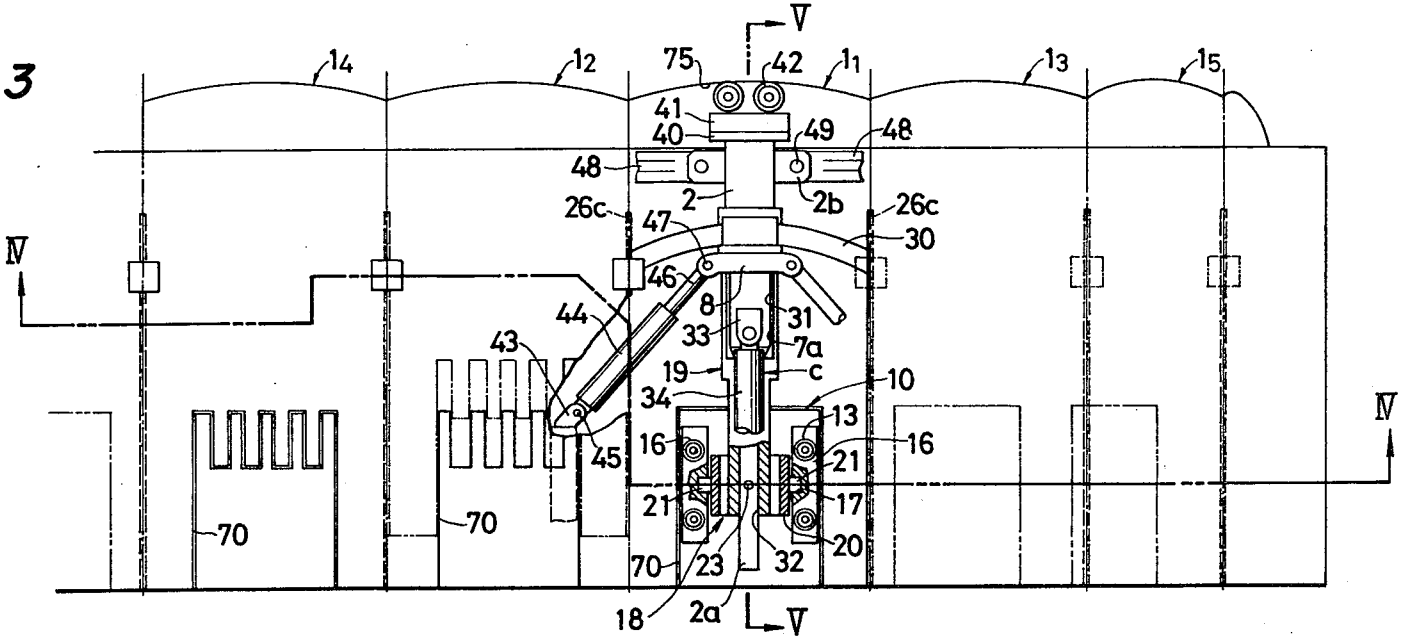
FIG. 3 is a plan view partly in section and partly broken away showing an embodiment of the present invention.

The excavating machines $1_1$, $1_2$ --- $1_5$ are provided with gripper mechanisms 10, respectively. Each of the gripper mechanisms 10 has upper gripper shoe 11 and lower gripper shoe 12 and these shoes 11, 12 are slidably fitted in the cut-out portions 70 and are connected to piston rods 14, 15 (FIG. 5) of the two piston type hydraulic gripper cylinders 13 (FIG. 3). The gripper cylinders 13 are housed in the left and right gripper bodies 16 (FIG. 3). Thus, when the gripper cylinders 13 are actuated, the upper and the lower gripper shoes 11, 12 are pushed outwardly by the piston rods 14, 15 so as to firmly abut against the ceiling portion 73 and the remaining portion 74.

Bearing portions 17, 17 are formed in the inwardly facing surfaces of the left and right gripper bodies 16, 16 and the gripper mechanism 10 is connected through universal joint mechanism 18 to a swinging mechanism 19. The universal joint mechanism 18 is provided with a swingable ring 20 having oppositely extending pins 21, 21 which are rotatably received in the above described bearing portions 17, 17. Further bearing portions 22, 22 are formed at the upper and lower side portions of the ring 20 into which pins 23, 23 secured to the upper and lower portions at the rear end of the support cylinder body 7 of the swinging mechanism 19 are rotatably received. Thus, the support cylinder body 7 can be swung in any direction by the universal joint mechanism 18.

Figure 5:
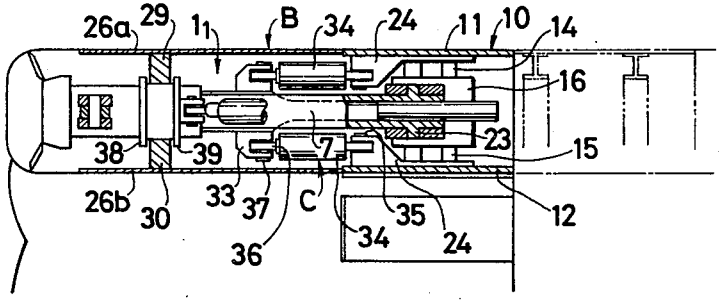
FIG. 5 is a fragmentary sectional view taken along line V — V in FIG. 3.

As shown in FIG. 5, brackets 24 are secured to the inner wall of the upper and lower gripper shoes 11, 12 adjacent to the forward ends thereof. An upper and lower guides 29, 30 are secured to the partitions 26*c*, 26*c* at the forward portion of the shield body 26 as seen in FIGS. 3 and 5. As shown in FIG. 3 the guides 29, 30 have a curvature the center of which lies in the axis of the above described pins 23. The forward portion of the support cylinder body 7 of the swinging mechanism 19 is enlarged in diameter to form a major diameter portion 7*a*, and a bracket 8 is fixedly secured to the forward end of the major diameter portion 7*a*. Axially elongated openings 31 are formed in the upper and lower sides of the major diameter portion 7*a*. The support cylinder body 7 slidably and rotatably supports the excavator body 2. To this end, the rear portion of the excavator body 2 is reduced in diameter to form a minor diameter portion 2*a* and the minor diameter portion 2*a* is slidably and rotatably fitted in a sliding hole 32 formed in the rear portion of the support cylinder body 7.

Brackets 33 are fixedly secured to the upper and lower portions of the excavator body 2 and they are positioned in the above described openings 31. The proximal ends of the hydraulic cylinders 34 which serve as the thrust generating mechanism c are pivotally mounted by pins 35 in the brackets 24, 24 of the gripper mechanism 10 while the rods 36 of the cylinders 34 are mounted by pins 37 in the brackets 33 of the excavator body 2.

A pair of axially spaced flange members 38, 39 are formed adjacent to the forward portion of the excavator body 2, and the portion of the excavator body between the flange member 38, 39 is slidably and rotatably engaged with the slot formed between the above described guides 29, 30.

Figure 9:
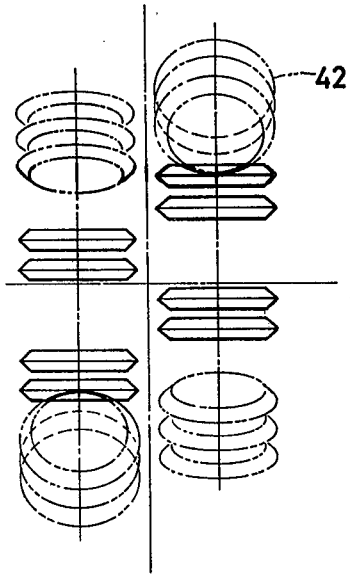
FIG. 9 is a front view showing the arrangement of the crushing tools in the excavating machine.
Figure 8:
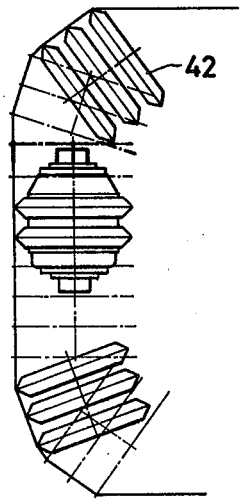
FIG. 8 is a side view showing the arrangement of the earth crushing tools in the excavating machine.
Figure 10:
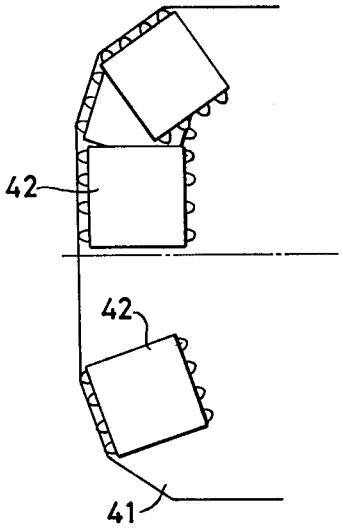
FIGS. 10 – 12 are side views showing the alternative forms of the crushing tools in the excavating machine with a portion being omitted.
Figure 11:
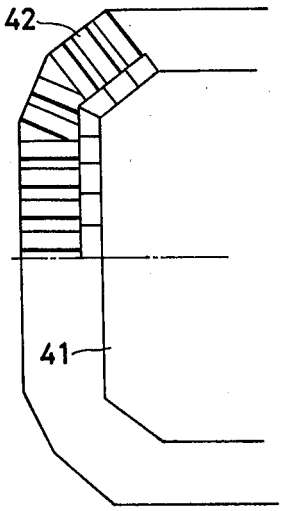
Figure 12:
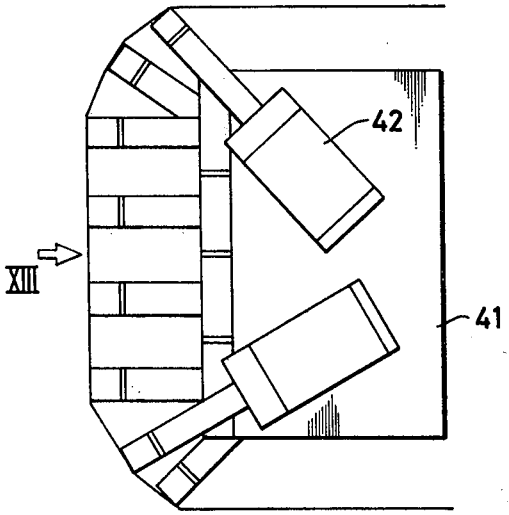
Figure 13:
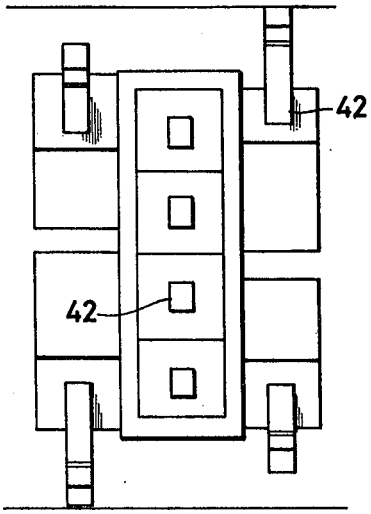
FIG. 13 is a view as seen from the direction XIII in FIG. 12.

A mounting seat 40 is formed on the tip of the excavator body 2 and an excavator head 41 is mounted on the mounting seat 40. A plurality of earth crushing tools 42 are provided on the head 41. The crushing tools 42 may be in the form of disc cutters as shown in FIGS. 8 and 9, or they may be in the form of roller cutters as shown in FIG. 10. Alternatively, the crushing tools 42 may be tool bits as shown in FIG. 11, or they may be also in the form of impact breaker as shown in FIGS. 12 and 13.

As described previously, the excavating machines constructed as described above is located in each of the chambers $A_1$, $A_2$, $A_3$, $A_4$ and $A_5$ formed by the partitions 26*c* in the shield body 26, and the gripper mechanisms 10 of the excavating machines $1_2$, $1_3$ located in the chambers $A_2$, $A_3$ at the respective sides of the central chamber $A_1$ are provided with mounting brackets 43 as shown in FIG. 3. The proximal ends of hydraulic cylinders 44 for the swinging of the excavating machine 1, are pivotally mounted by pins 45 in the mounting brackets 43 while the rods 46 of the cylinders 44 are pivotally mounted on the bracket 8 of the support cylinder body 7 by means of pins 47. The excavating machines $1_2$, $1_3$ --- $1_5$ except the excavating machine $1_1$ located in the central chamber $A_1$ are not provided with such hydraulic cylinders 44, and instead, the adjacent two of the excavating machines are connected by connecting members 48 which are pivotally mounted at their ends by pins 49 in the brackets 2*b*, 2*b* provided in the respective excavating machines so that, when the central excavating machine $1_1$, is swung by the action of the hydraulic cylinders 44, the remaining excavating machines $1_2$, --- $1_5$ are also swung in unison with the central excavating machine $1_1$.

Figure 4:
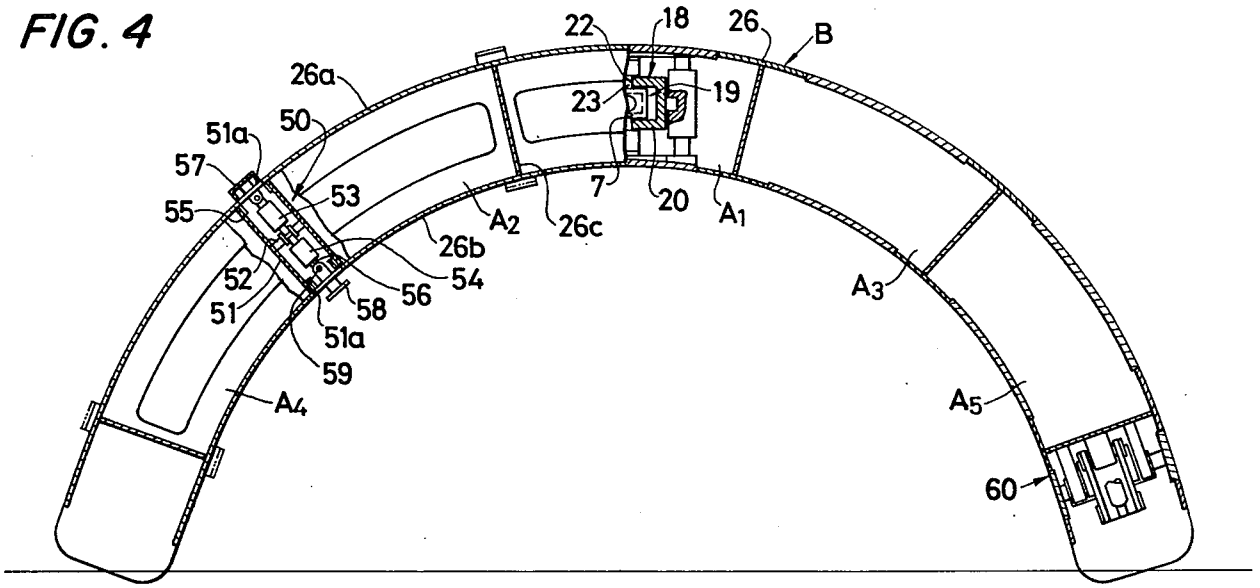
FIG. 4 is a cross-sectional view taken along line IV — IV in FIG. 3.

As shown in FIG. 4, the shield body 26 is provided with support mechanism 50. These support mechanisms 50 have support housings 51 in which brackets 52 are integrally secured as shown. The proximal ends of hydraulic cylinders 53, 54 are mounted on the brackets 52 while the rods 55, 56 of the cylinders 53, 54 are pivotally mounted in the support shoes 57, 58 by pins 59. The support shoes 57, 58 are shiftably fitted in holes 51*a* formed in the opposite ends of the housing 51 so that, when the cylinders 53, 54 are actuated, the support shoes 57, 58 are forced outwardly so as to temporarily abut securely against the upper and lower surfaces of the solid earth formed by the upper half annular hollow space excavated by the tunnel excavator so that the shield body 26 is securely held with respect to the solid earth. The action of the support mechanism 50 will be described later.

Figure 6:
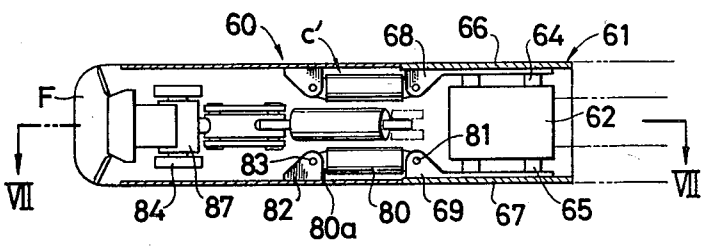
FIG. 6 is a plan view showing the corner excavating machine with a portion being omitted.
Figure 7:
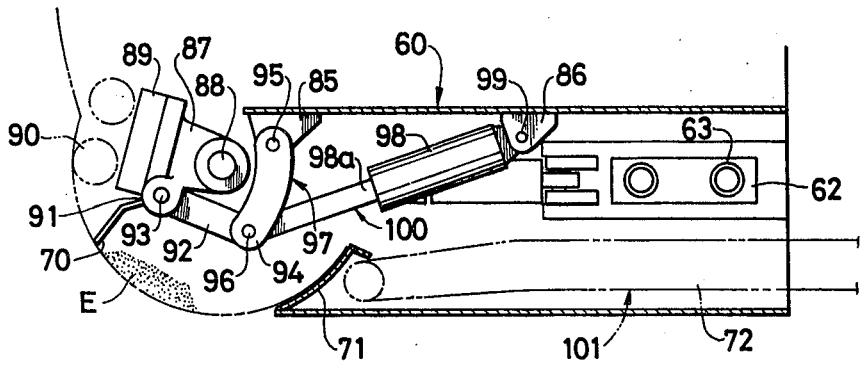
FIG. 7 is a sectional view taken along line VII — VII in FIG. 6.

Corner excavating machines 60 are provided at both extremities of the shield body 26 of the arch shaped shield B as shown in FIG. 4. These corner excavating machines 60 are provided with gripper mechanisms 61, respectively, as shown in FIG. 6. The gripper mechanism 61 has a gripper body 62 in which hydraulic cylinders 63 are housed (FIG. 7). The rods 64, 65 of the cylinders 63 are connected to upper and lower gripper shoes 66, 67 which are shiftably fitted in cut-out portions in the upper and lower skin plates of the shield body 26 as shown in FIGS. 4 and 6. Brackets 68, 69 are secured to the inner walls of the gripper shoes 66, 67, and the proximal ends of hydraulic cylinders 80, 80 which serve as the thrust generating mechanism *c'* are connected by pins 81 to the brackets 68, 69, while the rods 80*a* of the cylinders 80 are connected by pins 83 to brackets 82 fixedly secured to the inner walls of the upper and lower skin plates of the shield body 26, so that, when the cylinders 63 are actuated, the gripper shoes 66, 67 firmly engage with the upper and lower surfaces of the solid earth and, when the cylinders 80 are actuated, the shield body 26 can be advanced with respect to the solid earth with which the gripper shoes 66, 67 firmly engage.

Mounting brackets 84 are fixedly secured to the partition 26*c* of the shield body 26 and the corner excavator body 87 is swingably mounted on the brackets 84 by shaft pin 88.

Mounting brackets 85, 86 are secured to the partition 26*c* of the shield body 26.

A bracket 91 is formed at the side of the excavator body 87 and one end of a link 92 is pivotally connected to the bracket 91 by a pin 93. The other end of the link 92 is pivotally connected by pin 96 to one ends of links 94 the other ends of which are pivotally mounted by pin 95 on the bracket 85. The proximal end of hydraulic cylinder 98 is pivotally mounted by pin 99 on the bracket 86 while the rod 98*a* of the cylinder 98 is pivotally connected to the joint of links 92, 94 by the pin 96. Thus, a link mechanism 97 is constructed by the links 92, 94 and pins 93, 95, 96. The link mechanism 97 together with the hydraulic cylinder 98 constitutes a swinging mechanism 100.

The excavator body 87 is provided with an excavating head 87 fixedly secured thereto to which earth crushing tools 90 are mounted in the manner previously described.

Therefore, when the cylinder 98 is actuated, the excavator body 87 is reciprocally swung through links 92, 94 so that excavation is effected by the crushing tools 90.

A scraper 70 is provided in the excavator body 87 and an apron 71 is formed at each of the sides of the shield body 26. The forward end of a conveyor 72 extends into the shield body 26 as shown in FIG. 7. The forward end of the conveyor 72 is located beneath and rearward of the apron 71 so that a transporting mechanism 101 is constituted thereby which transports pebbles generated during the excavation out of the tunnel excavator.

The operation of the above described tunnel excavator is as follows.

The hydraulic cylinders 13 of the gripper mechanism 10 are first actuated so as to extend the rods 14, 15 so that upper and lower gripper shoes 11, 12 are firmly engaged with the upper ceiling portion 73 and the remaining portion 74 thereby constituting firm support against the reaction of the cylinders 34.

Then, the thrust generating cylinders 34 are actuated so as to extend their rods so that the excavating body 2 is advanced thereby permitting the crushing tools 42 to abut against the solid earth to be excavated.

In excavating operation, the hydraulic cylinders 44, 44 for swinging the central excavating machine $1_1$ are alternately actuated so that the excavator body 2 is reciprocally swung left and rightwards. Since the remaining excavating machines $1_2 - 1_5$ are connected to each other and to the excavating machine $1_1$ by connecting members 48, all the excavating machines $1_1$, $1_2 - 1_5$ are swung in unison when the excavating machine $1_1$ is reciprocally swung by the cylinders 44. The arch shaped guides 29, 30 formed in the shield body 26 guide the swinging movement of the excavating machines. Universal joint mechanism 18 serve to guide the rotational movement of the excavating machines so that the excavating machines can effect the excavation of the solid earth by the crushing tools 42 in accordance with the intended arcuate form.

At the same time, in the corner excavating machines 60 the hydraulic cylinders 63 are actuated so that the upper and lower gripper shoes 66, 67 are firmly engaged with the ceiling portion 73 and the remaining portion 74 of the solid earth. Thus the gripper mechanism 61 constitutes the support against the reaction of the cylinders 80. The cylinders 80 are then actuated to advance the shield body 26 so that the crushing tools 90 of the head 89 of the excavator body 87 abut against the solid earth to be excavated.

The advance of the shield body 26 is effected by the flange members 38, 39 of the excavator body 2 engaging with the guides 29, 30 of the shield body 26 as well as by the actuation of the cylinders 80. The corner excavating body 87 is reciprocally swung about the shaft pin 88 by the actuation of the hydraulic cylinder 98 through the link mechanism 97 thereby permitting the crushing tools 90 of the head 89 to excavate the solid earth in arcuate form.

The pebbles E generated by the actuation of the excavating machines $1_1$, $1_2 - 1_5$ other than the corner excavating machines 60 will fall to the left and right sides of the groove F formed by the excavation of the solid earth, and the pebbles are gathered by the scraper 70 onto the apron 71 so that the pebbles are discharged rearwardly by the conveyor 72 out of the tunnel excavator.

After intended excavation of the solid earth, the cylinders 53, 54 of the support mechanisms 50 are actuated so that the support shoes 57, 58 are engaged with the ceiling portion 73 and the remaining portion 74 of the solid earth so as to secure the arch shaped shield B with respect to the earth. Then, the cylinders 13, 63 of the gripper mechanisms 10, 61 are deenergized to release the upper and lower gripper shoes 11, 12, 66, 67 from the earth and the thrust generating cylinders 34, 80 are contracted so as to advance the gripper mechanism After the gripper mechanism 10, 61 are advanced, the support mechanisms 50 are released and the gripper mechanisms 10, 61 are actuated so that the aforementioned excavation operation is repeated.

As described above, the present invention provides very efficient and inexpensive tunnel excavator which is simple in construction and is adapted to be used in any scale of the construction work.

We claim:

1. A tunnel excavator for forming an upper half annular hollow space within the solid earth having an arch shaped shield provided therein with a plurality of chambers in which excavating machines are located, respectively, each of said excavating machines including an excavator body, earth crushing tools provided on said body, and gripper means provided in each of said chambers for securely abutting against the outer and inner surfaces of the solid earth formed by said upper half annular hollow space, wherein the improvement comprises support cylinder means connected to said gripper means through universal joint means, said support cylinder means rotatably supporting said excavator bodies, respectively, thrust generating means provided in each of said chambers and connected between said gripper means and said excavator body for advancing said excavator body by the action of said thrust generating means when said gripper means is securely abutted against said outer and inner surfaces of the solid earth formed by said upper half annular hollow space, guide means each engaging with the respective excavator bodies so as to permit the same to be swung in an arcuate path, connecting means connecting respectively the adjacent two excavator bodies of said excavator machines so that swinging movement of any one of said excavator bodies is transmitted to the remaining excavator bodies, and swinging means connected to the excavator body of at least one of said excavator machines for permitting the same to be swung by the action of said swinging means.

2. A tunnel excavator for forming an upper half annular hollow space within the solid earth having an arch shaped shield provided therein with a plurality of chambers in which excavating machines are located, respectively, each of said excavating machines including an excavator body, earth crushing tools provided on said body, and gripper means provided in each of said chambers for securely abutting against the outer and inner surfaces of the solid earth formed by said upper half annular hollow space, wherein the improvement comprises first swinging means for swingably and rotatably supporting said excavator bodies in said chambers except those located at the extremities of said shield, second swinging means for swingably supporting said excavator bodies in said chambers located at the extremities of said shield, thrust generating means provided in each of said chambers and connected between said gripper means and said excavator body for advancing said excavator body by the action of said thrust generating means when said gripper means is securely abutted against said outer and inner surfaces of the solid earth formed by said upper half annular hollow space so as to permit said earth crushing tools to be operated to excavate the earth for the intended cross section thereof, pebble discharging means located at the extremities of said shield for transporting pebbles generated during the excavation of the earth out of said tunnel excavator, and supporting means located in said shield for temporarily abutting securely against said outer and inner surfaces of the solid earth formed by said upper half annular hollow space thereby permitting said gripper means to be advanced by the action of said thrust generating means during the time said gripper means is inactivated.

* * * * *